US005232254A

United States Patent [19]

Teaff

[11] Patent Number: 5,232,254

[45] Date of Patent: Aug. 3, 1993

[54] DOOR SECURING DEVICE

[76] Inventor: Josette C. Teaff, P.O. Box 821204, Houston, Tex. 77282-1204

[21] Appl. No.: 936,297

[22] Filed: Aug. 28, 1992

[51] Int. Cl.[5] ..... E05B 9/00

[52] U.S. Cl. ..... 292/259 R; 292/281

[58] Field of Search ..... 292/259, 260, 262, 285, 292/286, DIG. 46, 281

[56] References Cited

U.S. PATENT DOCUMENTS

| | | | |
|---|---|---|---|
| 212,242 | 2/1879 | Loper, Jr. | 292/259 |
| 1,224,391 | 5/1917 | Livingston | 292/285 |
| 3,592,497 | 7/1971 | Logen, Jr. | 292/259 |
| 3,809,417 | 5/1974 | Craig | 292/259 |
| 4,601,503 | 7/1986 | Wicks, Sr. | 292/259 R |
| 4,779,910 | 10/1988 | Dameron | 292/259 R |
| 5,010,747 | 4/1991 | Norden, Jr. | 292/259 R X |

*Primary Examiner*—Richard E. Moore
*Attorney, Agent, or Firm*—Harrison & Egbert

[57] ABSTRACT

A door locking device having a first bracket with a slot formed thereon and extending outwardly from a flat surface, and a second bracket having a slotted member hingedly connected thereto. The first bracket has a first stop member extending from the flat surface adjacent an open end of the slot. The second bracket has a second stop member connected thereto and positioned adjacent an open end of the slotted member opposite the first bracket. The second bracket includes a flat member, a hinge joining the slotted member to the flat member, and a receiving latch fastened to the flat member and extending outwardly therefrom. The hinge causes the slotted member to be movable between an open position and a closed position. The slotted member has a slit which extends around the exterior of the receiving latch when the slotted member is in the closed position. A rigid bar is received by the slot of the first bracket and by the slotted member of the second bracket so as to be rigidly contained therein and therebetween. The rigid bar has an engagement member connected thereto for suitable receipt by the receiving latch of the second bracket.

19 Claims, 2 Drawing Sheets

DOOR SECURING DEVICE

TECHNICAL FIELD

The present invention relates to apparatus used for the securing and locking of doors. More particularly, the present invention relates to devices providing security against the opening of a door inwardly for unauthorized purposes.

BACKGROUND ART

The alarming increase of crime, violence and murder in recent years has brought about a greater need for security devices. The traditional methods of preventing forced entry, the use of locks and deadbolts, has not fulfilled society's needs. An average adult male or muscular female, intent on gaining forced entry, could generally kick in a door, no matter how many locks and deadbolt s have been installed.

Electronic surveyance systems have proved inadequate. The savvy hit-and-run criminal often escapes before the police arrive. He is frequently knowledgeable about response times. Traditional gates, commonly swinging on hinges, are often expensive and not appropriate for today's buildings. Many high density structures forbid them.

Therefore, there is a need for a device that will secure doors from forced entries. This is particularly applicable in areas of high-density structures in which the entry door is the only method of entrance. It is desirable to provide such a device which can be easily used and effective in preventing unauthorized entry.

In the past, various patents have issued relating to door securing devices. U.S. Pat. No. 313,942, issued on Mar. 17, 1885, to D. H. Knauer discloses a bar for securing doors and shutters. A plurality of keepers are positioned on a surface of the door so as to receive an exterior of a rigid bar. The rigid bar is pivotally connected to a mechanism on the door jamb. U.S. Pat. No. 1,748,598, issued on Feb. 25, 1930, to M. Dermody discloses a locking device for a door in which a bar is pivotally connected to a surface of the door. The bar is free to move about the pivot point so as to engage slots mounted on the door jamb, in one position, and to be free of the slots on the door jamb in another position. A locking member is connected, by a chain, to the bar so as to secure the bar in position. U.S. Pat. No. 2,130,216, issued on Sep. 13, 1938, to G. Zaninovich, describes a door locking bar which is rotatably mounted to the door. One end of the bar is received at one side of the door. The other end of the bar includes a slot which is pivotally connected to an end of the bar so as to engage a receiving latch. A lock can be mounted into the receiving latch so as to place the slot in proper engagement to a surface on the side of the door. U.S. Pat. No. 3,809,417 issued on May 7, 1974, to R. T. Craig shows a security device for use in securing doors against intruders. This security device has telescoping members which are pivotally mounted at one end to a door facing. It has a receiving member on the opposite door facing so as to receive the other end. Means are provided for anchoring the parts in their respective positions. U.S. Pat. No. 4,601,503, issued on Jul. 22, 1986, to J. L. Wicks, Sr. provides a device for securing doors against break-in. The invention consists of a hasp-like retainer member, an eye-type retainer member, and a bar-like security piece of rectangular cross-section. The retainer members are affixed to a wall or door casing on each side of the doorway and are secured at approximately the mid-height of the door. The hasp-like retainer, which is hinge-like in operation, may be folded back against the wall when not in use. When in use, the hasp-like is opened to a position generally perpendicular to the face of the wall of the casing. U.S. Pat. No. 4,772,053, issued on Sep. 20, 1988, to R. C. Oxley discloses a vandal-proof crossbar assembly for securing a door. This assembly includes first and second mounting members secured on opposite sides of the door and a crossbar which is secured within the mounting members by a shackle lock. The locks attach to pivot posts extending from the mounting members. The posts pivot freely about a first axis, and the shackles each define a loose hinge about a second orthogonal axis, so that with one lock detached the crossbar hangs freely and moves in a multi-axis articulated motion which prevents vandalism by prying and forcing the bar. U.S. Pat. No 5,014,527, issued on May 14, 1991, to Traller et al. provides a security device for protecting a door from forced entry. The device consists of two brackets, a rigid form and one or more male protrusions. The brackets are securely attached to both sides of a door jamb and secured adjacent and perpendicular to the center line of the keyed lock of the door. The form slides into the brackets, buttressed in place with the male protrusions when the door is closed.

It is an object of the present invention to provide a door securing device which effectively prevents forced entry inwardly of the door.

It is another object of the present invention to provide a door securing device which is relatively simple to use, easy to manufacture, and relatively inexpensive.

It is a further object of the present invention to provide a door securing device which resists the manipulation-style of forced entry.

These and other objects and advantages of the present invention will become apparent from a reading of the attached specification and appended claims.

SUMMARY OF THE INVENTION

The present invention is a door securing device which comprises a first bracket having a first slot therein, a second bracket having a second slot formed therein, and a rigid bar which is secured within the first slot of the first bracket and within the second slot of the second bracket. The first bracket has suitable means for fastening it to a surface adjacent a side of a door. The second slot is in hinged relationship with a surface of the second bracket. The second slot is movable between an open position and a closed position. A receiving latch is affixed to the second bracket and engages the second slot when the second slot is in the closed position. The second bracket also has means thereon for fastening to a surface adjacent an opposite side of the door.

The first bracket has a flat surface formed thereon. The first slot extends upwardly from this flat surface. The first slot has a generally D-shaped configuration. This first slot has a size greater than the perimeter of the rigid bar. The first bracket also has a stop member which is positioned on a side of the first slot opposite the second bracket. The stop member is affixed to the flat surface and extends perpendicularly therefrom.

The second bracket also has a flat surface formed thereon. The receiving latch is affixed to the flat surface. The second slot has a hinge which is affixed to the flat surface of the second bracket and extends laterally across the second bracket. The second slot has a generally U-shaped configuration. The U-shaped configuration of the second slot is connected at one end to the hinge. A stop member is affixed to the flat surface of the second bracket and is positioned so as to be on a side of the U-shaped configuration opposite the first bracket. The second slot has a strut portion which extends below the U-shaped configuration. This strut portion has a slit formed therein. The slit has a size suitable for sliding relationship over the receiving latch. The receiving latch extends outwardly through the slit when the second slot is in the closed position.

The rigid bar has an engagement member connected thereto. This engagement member is suitable for receipt within the receiving latch. The engagement member is movable between a position within the receiving latch and a position free of the receiving latch. The engagement member specifically comprises a hook which is tethered to the rigid bar.

DETAILED DESCRIPTION OF THE INVENTION

Figure 1:
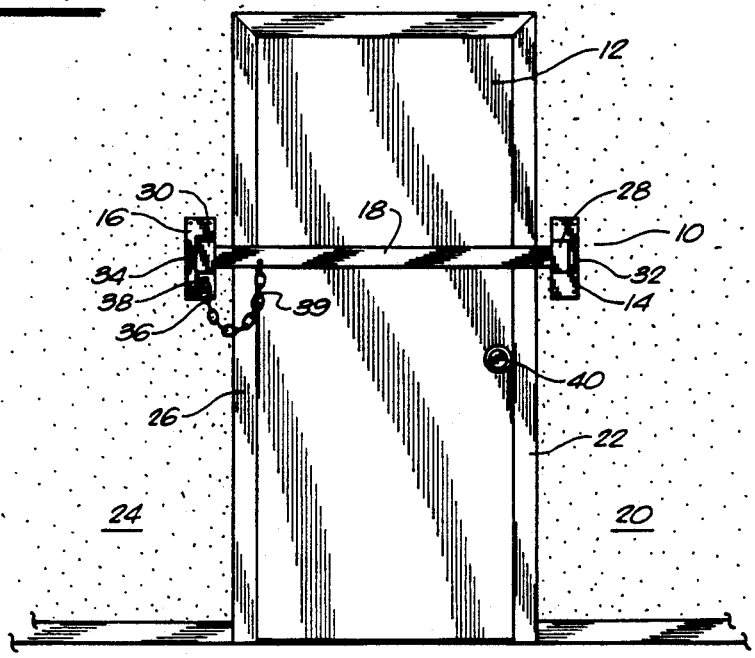
FIG. 1 is a front elevational view showing the configuration of the door securing device of the present invention as positioned adjacent to a door.

Referring to FIG. 1, there is shown at 10 the door securing device in accordance with the preferred embodiment of the present invention. The door securing device 10 is positioned on opposite sides of door 12 so as to secure the door from forced entry. The door securing device 10 comprises a first bracket 14, a second bracket 16, and a rigid bar 18.

The first bracket 14 is securely fastened to a wall 20 adjacent to door jamb 22 along one edge of door 12. The second bracket 16 is positioned on wall 24 adjacent door jamb 26 on an opposite side of door 12. It can be seen that the rigid bar 18 extends across the surface of door 12, across the surfaces of door jambs 22 and 26, and engages the brackets 14 and 16 on walls 20 and 24, respectively. The rigid bar 18 engages a first slot 28 on first bracket 14. The rigid bar 18 also engages a second slot 30 on second bracket 16. The first bracket 14 includes a stop member 32 positioned on one side of the rigid bar-receiving slot 28. Similarly, the second bracket 16 includes a second stop 34 positioned on a side of the second slot 30 opposite the door 12. The stops 32 and 34 are positioned so as to maintain the rigid bar 18 in its proper position within slots 28 and 30. The stops 32 and 34 effectively prevent any vibration or manipulation from causing the bar 18 to slide from its intended position within the slots 28 and 30. As can be seen, the stops 32 and 34 prevent any longitudinal movement of rigid bar 18 in either direction.

FIG. 1 also shows that an engagement member 36 is tethered, by way of chain 39 to rigid bar 18. As will be described hereinafter, the engagement member 36 is a hook which is received within a receiving latch 38 on the second bracket 16. This hook/receiving latch configuration serves to retain the rigid bar 18 within its proper position in the second slot 30. The receiving can take on a wide variety of shapes or configurations. It is only necessary that the receiving latch retain the slot 28 in a fixed position. In order to manipulate the rigid bar 18 so as to bring it into the position illustrated in FIG. 1, the only manipulation will occur on the hinged slot 30 on the second bracket 16. It can be seen that the second bracket 16 is positioned on the opposite side of the door from the door knob 40. As such, it is impossible for a would-be intruder to open the door 12 a small distance so as to allow access to the rigid bar 18 for the purpose of manipulating and opening the security device 10.

Figure 2:
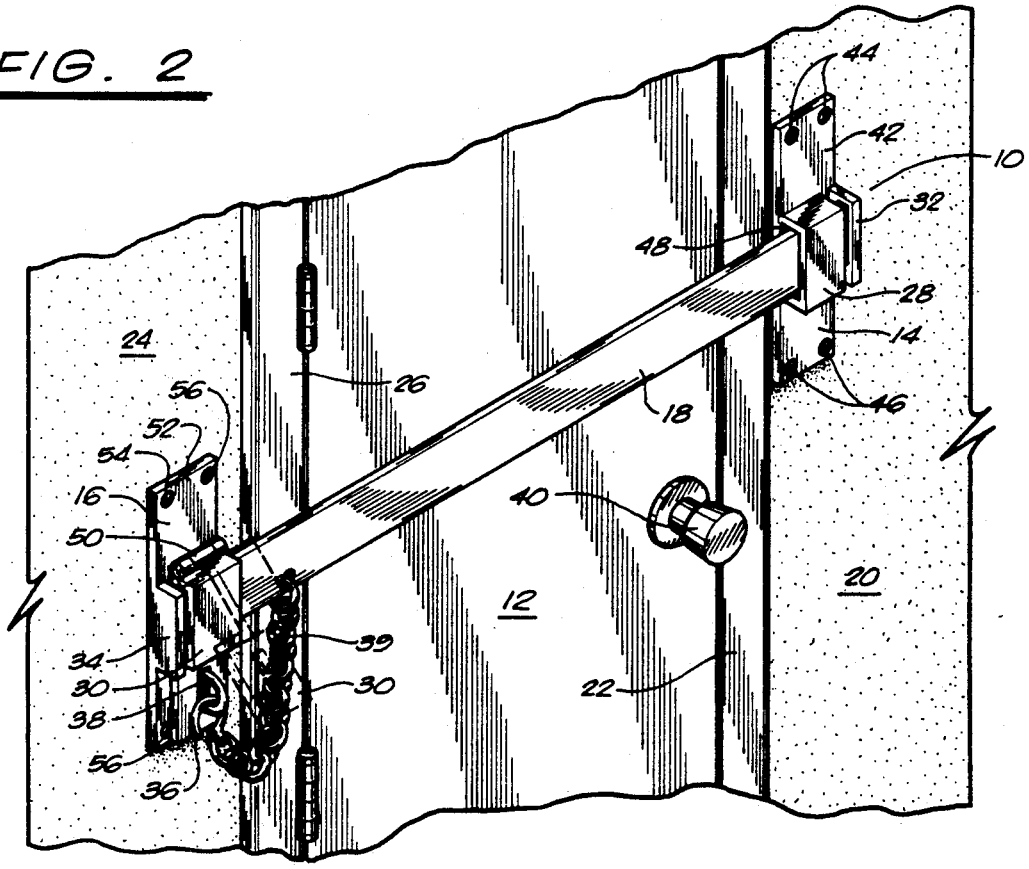
FIG. 2 is a perspective view of the door securing device of the present invention showing the operation of the slotted member of the second bracket in dotted line fashion.

FIG. 2 is a detailed view showing the arrangement of the securing device 10 of the present invention. Specifically, in FIG. 2, it can be seen that the securing device 10 is positioned across the face of door 12. The securing device has the first bracket 14 positioned on wall 20 so as to receive one end of the rigid bar 18. The first slot 28 has a generally rectangular or D-shaped configuration. This slot 28 is positioned on a flat surface 42 of bracket 14. Flat surface 42 includes suitable fastening means 44 and 46 for fastening the flat surface 42 of bracket 14 to wall 20. Specifically, the fastening means 44 and 46 can be molybolts, nut/bolt arrangements, screws, or other securing devices. The stop member 32 is positioned on the side of the slot 28 opposite the door 12. The stop 32 is essentially a flat rigid member that extends outwardly perpendicularly to the flat surface 42 of bracket 14. As shown in FIG. 2, the first bracket 14 is secured to wall 20 adjacent to the door jamb 22. However, in keeping with the concept of the present invention, the first bracket 14 can also be fastened to the door jamb 22 directly. The slot 28 has a generally rectangular opening 48 which has a size greater than the perimeter of the rigid bar 18. The opening 40 of slot 28 should be suitable so as to allow the rigid bar 18 to easily slide into position within the slot 28.

As shown in FIG. 2, the rigid bar 18 is positioned above the door knob 40. However, this should not be construed as a limitation on the present invention. The rigid bar 18, and the associated brackets 14 and 16, may be positioned above or below the door knob 40. It is important to the present invention that the second bracket 16 be positioned on an opposite side of the door from the door knob 40 so as to prevent manipulation through any door opening. The rigid bar 18 is a generally flat rectangular piece of steel, or other rigid material, which has a strength suitable for preventing forced entry through door 12.

In FIG. 2, the second bracket 16 is shown as having the second slot 30 connected by hinge 50 to a flat surface 52 of the second bracket 16. The stop member 34 extends perpendicularly upwardly from the flat surface 52 and is positioned on an opposite side of the second slot 30 from the door 12. The second bracket 16 also includes means 54 and 56 which are suitable for fastening the second bracket 16 to the flat surface of wall 24. The second bracket 16 is shown as positioned on wall 24 adjacent to door jamb 26. However, it is possible, within the scope of the present invention, to fasten the second bracket 16 to the door jamb 26, directly. For proper operation of the present invention, it is desired that the brackets 14 and 16 be secured to the strongest surface readily available.

Importantly, FIG. 2 illustrates the operation of the second bracket 30 between its closed position (illustrated in solid line fashion) and its open position (illustrated in dotted line fashion). A receiving latch 38 is fastened to the flat surface 52 of second bracket 16 and extends outwardly therefrom. The second slot 30 includes a slit which can slidably pass over the exterior of receiving latch 38. The chain 39 has one end engaging rigid bar 18 and the other end fastened to the engagement member 36. It can be seen that the engagement member 36 comprises a hook which can be passed into and through the receiving latch 38. The receiving latch 38 is essentially a sturdy rigid ring which extends outwardly from the flat surface 52 of the second bracket 16. The engagement member can also be a bolt, a rigid bar, or other similar fasteners.

The second slot 38 can be moved between the open and closed position so as to receive an end of the rigid bar 18. When it is desired to position rigid bar 18 in the position illustrated in FIG. 2, then the slot 30 is moved outwardly relative to the hinge 50. The hinge 50 extends laterally across the flat surface 52 of bracket 16. Within the scope of this invention, the hinge may also extend longitudinally along the second bracket 16 such that the second slot 38 can be folded over the rigid bar 18 and the bearing latch 38. After the rigid bar 18 is positioned within second bracket 16, the second slot 38 is placed into its closed position such that the slit passes over the receiving latch 38 and the body of the slot 30 is placed in juxtaposition against the flat surface 52 of the second bracket 16. The hook can then be placed into engagement with the receiving latch 38 such that the second slot remains engaged with the rigid bar 18 contained therein. In that position, the door securing device 10 of the present invention is in proper condition for use.

Figure 3:
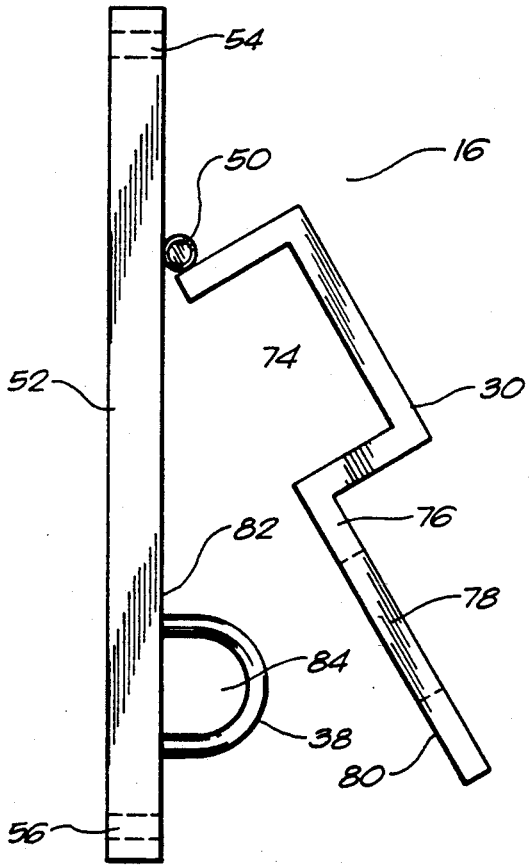
FIG. 3 is a side elevational view of the second bracket of the present invention.

FIG. 3 shows a detailed view of the second bracket 16. It can be seen that the second bracket 16 has a generally flat surface 52 which is a member suitable for fastening to an exterior surface, such as a wall or a door jamb. Suitable apertures 54 and 56 are provided at opposite ends of the flat surface 52 so as to allow the second bracket 16 to be fastened to the wall. It can be seen that the receiving latch 38 is a ring which has its ends fastened to the flat surface 52. A hinge 50 is also affixed to the flat surface 52 and to the second slot 30. It can be seen that the second slot 30 has a generally U-shaped configuration which includes an open area 74 suitable for receiving an end of the rigid bar 18. For the purposes of illustration, the stop member 34 is not shown in its normal position in FIG. 3.

The second slot 30 is movable between an open position (as shown in FIG. 3) and a closed position (shown in FIG. 2). The second slot 30 will simply rotate about the axis of hinge 50 so as to move angularly with respect to the flat surface 52. A strut portion 76 extends outwardly from the U-shaped configuration of slot 30 so as to provide a security surface for engagement with the receiving latch 38. A slit 78 is provided so as to pass over the exterior of the receiving latch 38 when the slot 30 is in its closed position. The inner surface 80 of strut portion 76 will rest in abutment with the top surface 82 of the bracket 16. When the engagement member passes through the opening 84 of receiving latch 38, the strut portion 76 of second slot 30 is secured in its proper position against the surface 82.

The present invention offers superior advantages over prior art door securing devices. First, the present invention extends across the entire width of the door. As such, the present invention prevents forced entry from either the breaking of the bolt or the disengagement of the hinges. Secondly, the location of the second bracket prevents manipulation by the would-be intruder since the bracket is located on the side of the door opposite the door knob. Thirdly, the present invention utilizes stop members on each end of the rigid bar so as to prevent the bar from movement by vibration or manipulation. Additionally, the present invention provides an aesthetically appealing apparatus for the bracing of a door.

The foregoing disclosure and description of the invention is illustrative and explanatory thereof. Various changes in the details of the illustrated construction may be made within the scope of the appended claims without departing from the true spirit of the invention. For example, the stop member may be positioned on a side of the hinged slotted member rather than positioned on the flat surface of the second bracket. The present invention should only be limited by the following claims and their legal equivalents.

I claim:

1. An apparatus for locking a door comprising:

a first bracket having a first slot formed therein, said first bracket having means for fastening to a surface adjacent a side of a door;

a second bracket having a second slot formed therein, said second slot in hinged relationship with a surface of said second bracket, said second slot movable between an open position and a closed position, said second bracket having a receiving latch affixed thereto, said receiving latch engaging said second slot when said second slot is in said closed position, said second bracket having means thereon for fastening to a surface adjacent an opposite side of the door; and a rigid bar received at one end by said first slot and at another end by said second slot.

2. The apparatus of claim 1, said first bracket having a flat surface formed thereon, said first slot extending upwardly from said flat surface, said flat surface having said means for fastening formed thereon.

3. The apparatus of claim 2, said first slot having a generally D-shaped configuration, said first slot having a size greater than a perimeter of said rigid bar.

4. The apparatus of claim 3, said first bracket having a stop member positioned on a side of said first slot opposite said second bracket, said stop member affixed to said flat surface and extending perpendicularly therefrom.

5. The apparatus of claim 1, said second bracket having a flat surface formed thereon, said flat surface having said means for fastening formed thereon, said receiving latch affixed to said flat surface.

6. The apparatus of claim 5, said second slot having a hinge affixed to said flat surface of said second bracket, said hinge extending laterally across said second bracket.

7. The apparatus of claim 6, said second slot having a generally U-shaped configuration, said U-shaped configuration connected at one end to said hinge, said second slot having a stop member affixed to said flat surface of said second bracket on to a side of said U-shaped configuration opposite said first bracket.

8. The apparatus of claim 1, said second slot having a strut portion extending below said U-shaped configuration, said strut portion having a slit formed therein, said slit having a size suitable for sliding relationship over said receiving latch, said receiving latch extending outwardly through said slit when said second slot is in said closed position.

9. The apparatus of claim 1, said rigid bar having an engagement member connected thereto, said engagement member suitable for receipt within said receiving latch, said engagement member movable between a position within said receiving latch and a position free of said receiving latch.

10. The apparatus of claim 9, said engagement member comprising a hook tethered to said rigid bar.

11. A door locking device for a hinged door comprising:

a first bracket having a generally D-shaped slot thereon, said first bracket having means for fastening to a surface adjacent the door;

a second bracket having a slotted member in hinged relationship therewith, said slotted member movable between an open position and a closed position, said closed position in juxtaposition against a flat surface of said second bracket, said second bracket having a means for fastening to a surface adjacent a hinge of the door, said second bracket having a receiving latch thereon, said receiving latch engaging said slotted member when said slotted member is in said closed position; and a rigid bar received at one end by said first bracket and at another end by said second bracket.

12. The device of claim 11, said first bracket having a first stop member fastened adjacent an end of said D-shaped slot, said end being opposite said second bracket.

13. The device of claim 12, said second bracket having a second stop member positioned adjacent so as to be a side of said slotted member opposite said first bracket.

14. The device of claim 11 said second bracket having a hinge fastened to and extending laterally across said flat surface of said second bracket.

15. The device of claim 11, said slotted member having a slit formed therein, said flat surface of said second bracket having said receiving latch extending outwardly therefrom, said slit of said slotted member sized to fit around said receiving latch when said slotted member is in said closed position.

16. The device of claim 15, said rigid bar having an engagement member connected thereto, said engagement member slidably received by said receiving latch of said second bracket, said engagement member in juxtaposition against said slotted member of said second bracket.

17. A door locking device comprising:

a first bracket having a slot formed on and extending outwardly from a flat surface, said first bracket having a first stop member extending from said flat surface adjacent an open end of said slot;

a second bracket having a slotted member hingedly connected thereto, said second bracket having a second stop member connected thereto, said second stop member positioned adjacent a side of said slotted member opposite said first bracket, said second bracket comprising:

a flat member having means thereon for fastening to a surface adjacent a door;

a hinge joining said slotted member to said flat member, said hinge causing said slotted member to be movable between an open position and a closed position; and a receiving latch fastened to said flat member and extending outwardly therefrom, said slotted member having a slit therein, said slit extending around an exterior of said receiving latch when said slotted member is in said closed position; and a rigid bar received at one end by said slot of said first bracket and at another end by said slotted member of said second bracket.

18. The device of claim 17, said rigid bar having an engagement member connected thereto, said engagement member received by said receiving latch, said engagement member in juxtaposition with said slotted member when said slotted member is in said closed position.

19. The device of claim 17, said hinge extending laterally across said flat member, said hinge connected to an end of said slotted member opposite said slit.

* * * * *